United States Patent [19]

Zimmer

[11] 4,120,484

[45] Oct. 17, 1978

[54] PANEL HOISTING AND POSITIONING DEVICE

[76] Inventor: James H. Zimmer, 312 Newfield Ave., Buffalo, N.Y. 14207

[21] Appl. No.: 849,889

[22] Filed: Nov. 9, 1977

[51] Int. Cl.[2] ..... B60P 1/12

[52] U.S. Cl. ..... 254/6 C; 214/1 SW

[58] Field of Search ..... 254/4 R, 4 C, 6 R, 6 C, 254/47, 95; 214/1 SW

[56] References Cited

U.S. PATENT DOCUMENTS

| | | | |
|---|---|---|---|
| 1,762,397 | 6/1930 | Kinser | 254/6 C |
| 2,983,474 | 5/1961 | Hanna | 254/4 C |

*Primary Examiner*—Robert C. Watson

*Attorney, Agent, or Firm*—Christel & Bean

[57] ABSTRACT

A device for hoisting and positioning drywall panels and the like comprising a maneuverable base, a raising and lowering mechanism extending from the base, and a panel supporting arrangement pivotally connected to the mechanism and including a pair of curved, resilient panel supporting elements each of which contacts the panel as spaced-apart locations. The raising and lowering mechanism includes three cylinders in a telescopic arrangement extending from the base, a rack and pinion combination for extending and retracting one cylinder relative to the other, and a coupling line connected at one end to a third cylinder, at the other end to the fixed one of the other cylinders, and operatively engaging the cylinder moved by the rack and pinion arrangement. Operation of the rack and pinion arrangement extends and retracts the one cylinder relative to the other and the coupling line simultaneously causes the third cylinder to be extended and retracted relative to the one cylinder.

14 Claims, 7 Drawing Figures

Fig. 3.
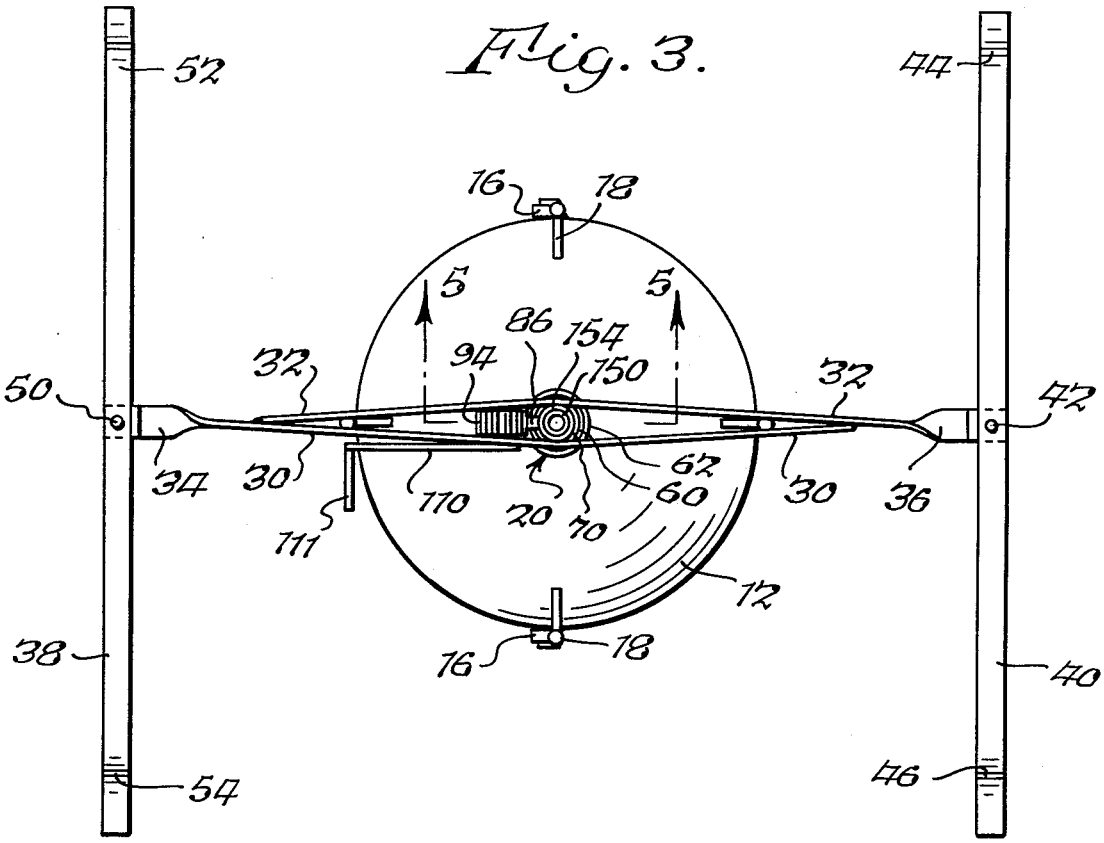
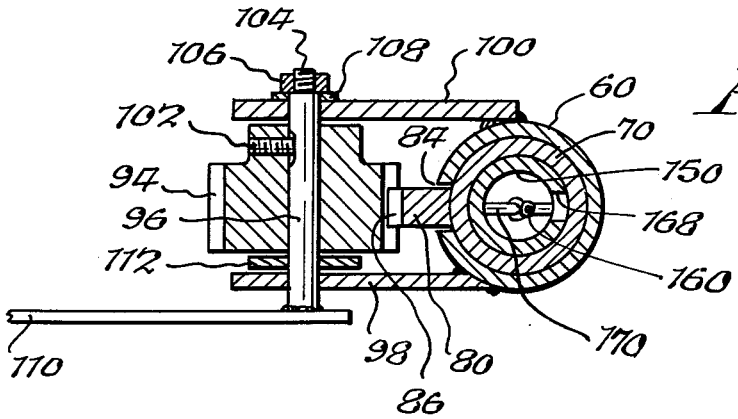
Fig. 4.

Fig. 5.
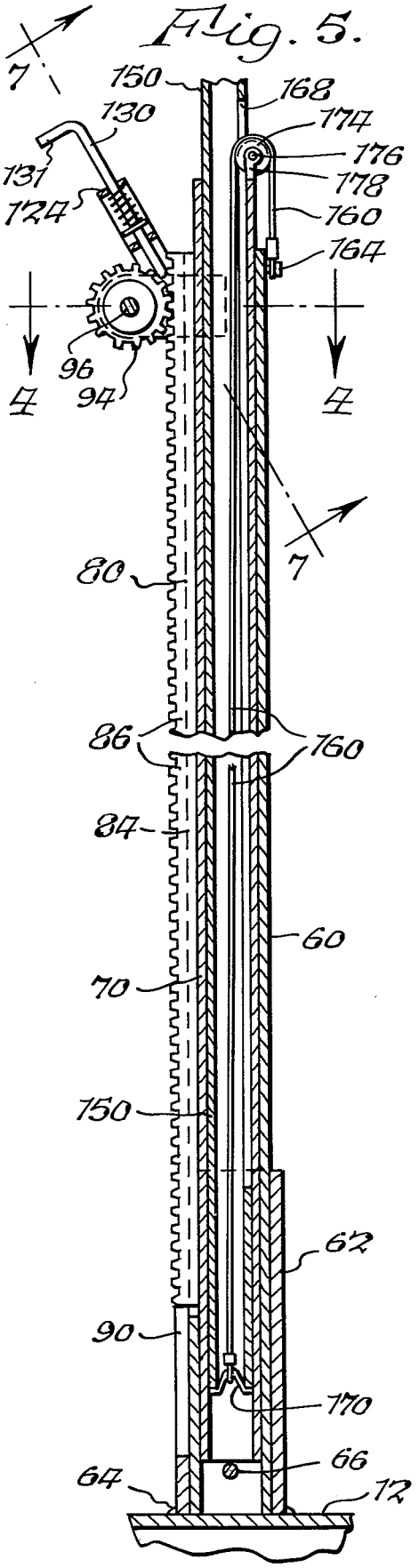
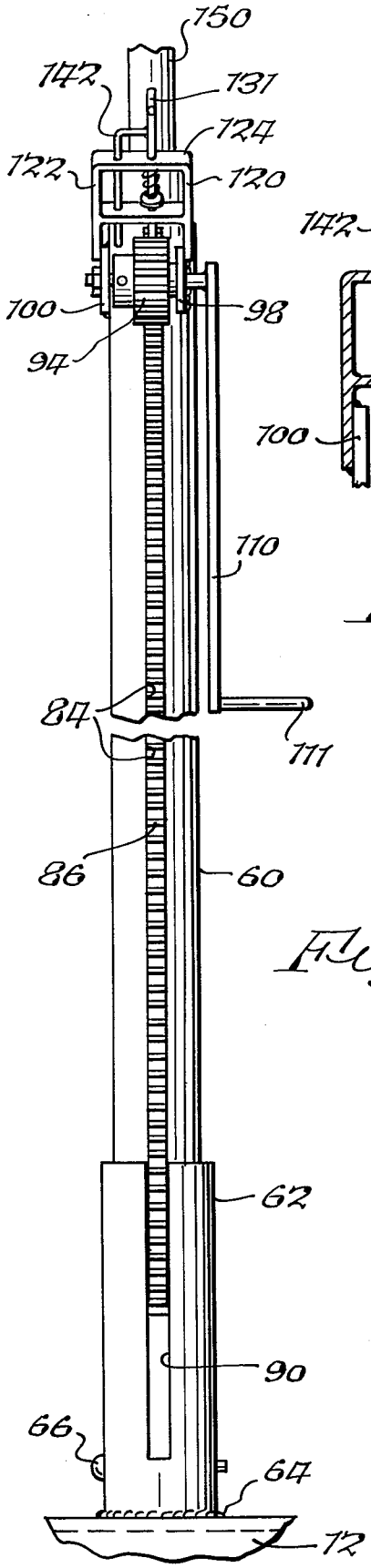
Fig. 6.
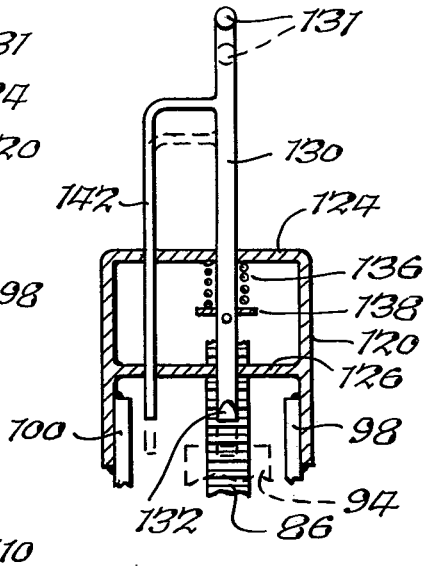
Fig. 7.

PANEL HOISTING AND POSITIONING DEVICE

BACKGROUND OF THE INVENTION

This invention relates to the art of hoisting and positioning apparatus, and more particularly to a new and improved device for hoisting and positioning drywall panels and the like.

One area of use of the present invention is hoisting and positioning drywall panels during construction of ceilings although the principles of the invention can be variously applied. A device for hoisting and positioning drywall panels advantageously can enable one person to hold and nail in place such panels in construction of ceilings. It would be highly desirable to provide such a device wherein the drywall panels are held effectively and positively in place during installation by an arrangement which is relatively simple in construction. It also would be highly desirable to provide such a device which is maneuverable both adjacent the bottom or base and the top where the panel is held. In addition, the raising and lowering mechanism should be effective in operation and relatively simple in construction.

SUMMARY OF THE INVENTION

It is, therefore, a primary object of the present invention to provide a new and improved device for hoisting and positioning drywall panels and the like.

It is a further object of this invention to provide such a device wherein the panels are held in an effective manner by a relatively simple arrangement.

It is a further object of this invention to provide such a device which is maneuverable both adjacent the base or bottom and adjacent the top where the panel is held.

It is a further object of this invention to provide such a device having a raising and lowering means which is effective in operation and relatively simple in construction.

It is a further object of this invention to provide such a device which is relatively economical to manufacture and convenient and easy to use.

The present invention provides a panel hoisting and positioning device comprising a maneuverable base, a raising and lowering means extending from the base, and panel supporting means including a pair of panel engaging elements each shaped so as to contact the panel at spaced-apart locations. The elements preferably are of resilient material, and the panel supporting means is pivotally connected to the raising and lowering means. The raising and lowering means comprises first and second relatively movable elongated elements extending from the base, motive means operatively associated with the first and second elements for causing relative movement between the elements, a third elongated element connected at one end to the panel supporting means and movable relative to the second element, and coupling means having a fixed length and fixed at opposite ends to the first and third elements and operatively engaging the second element between the ends of the coupling element. The motive means which can include a rack and pinion arrangement causes the second element to be extended and retracted relative to the first element, and the coupling means simultaneously causes the third element to be extended and retracted relative to the second element. The three elongated elements comprise an arrangement of three telescoping cylinders, and the apparatus includes holding means operatively associated with the motive means for maintaining a positional relationship between the first and second elements established by the motive means.

The foregoing and additional advantages and characterizing features of the present invention will become clearly apparent upon a reading of the ensuing detailed description together with the included drawing wherein:

BRIEF DESCRIPTION OF THE DRAWING FIGURES

FIG. 3 is a plan view taken about on line 3—3 in FIG. 1;

FIG. 4 is a sectional view taken about on line 4—4 in FIG. 5;

FIG. 5 is a fragmentary vertical sectional view of the device of FIG. 1;

FIG. 6 is a fragmentary elevational view of the device of FIG. 1 rotated about ninety degrees; and FIG. 7 is a fragmentary sectional view taken about on line 7—7 in FIG. 5.

DETAILED DESCRIPTION OF THE ILLUSTRATED EMBODIMENT

Figure 1:
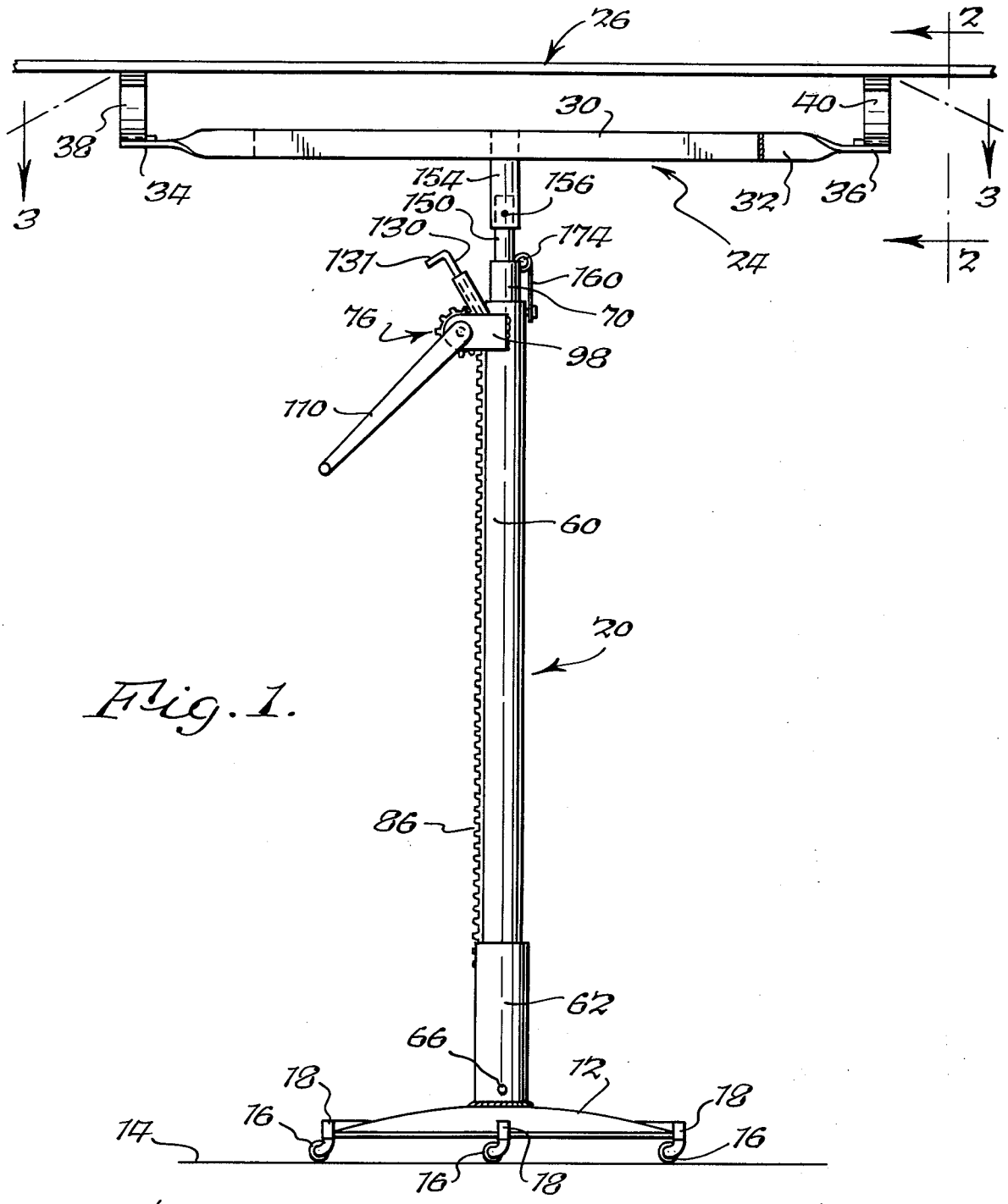
FIG. 1 is an elevational view of a panel hoisting and positioning device according to the present invention.

FIG. 1 shows a panel hoisting and positioning device according to the present invention which includes a maneuverable base 12 adapted to be moved along a supporting surface such as a floor 14 by means of a plurality of casters each comprising a wheel 16 rotatably connected to a leg-like bracket element 18 fixed to base 12 and depending therefrom. In the device shown four casters are connected to base 12 at ninety-degree angular intervals or quadrants therearound. Base 12 is generally circular in shape and preferably of metal, although other shapes and materials can be employed for the base 12.

The panel hoisting and positioning device according to the present invention further comprises a raising and lowering means generally designated 20 having a stationary component fixed to base 12 and at least one movable component operatively associated with the stationary component and adapted to be raised and lowered relative to base 12. The raising and lowering means 20 will be described in further detail presently. Suffice it to say, it is fixed at one end to base 12 and extends generally perpendicular to the plane of the supporting surface 14 during use, the raising and lowering means 20 being disposed vertically as viewed in FIG. 1. The movable component of the raising and lowering means is extended and retracted in a vertical direction in a manner which will be described in detail presently.

The panel hoisting and positioning device of the present invention further comprises panel supporting means generally designated 24 which is connected to the raising and lowering means 20 and which supports a panel element 26 for hoisting and positioning the same. In the device shown the panel 26 is of the commercially available drywall type which often is installed on ceilings, although the device of the present invention can be used for hoisting and positioning other types of panel elements. The panel supporting means 24 comprises bar means connected generally centrally thereof to a movable component of the raising and lowering means. In the device shown the bar means is provided by a pair of metal strip elements 30, 32 shown in FIG. 3 each disposed in planes generally parallel to the direction of movement of the raising and lowering means 20 and which are spaced apart in the central region thereof where they are joined such as by welding to an upper end of the raising and lowering means. Each of the bar elements 30 and 32 is bent or otherwise formed to include an outer tab portion 34 and 36, respectively, which is disposed in a plane at a right angle to the plane of the body portion of the bar. As shown in FIG. 3 one end of bar 30 is fixed such as by welding to bar 32 at a location slightly inwardly of the tab 36 of bar 32. Similarly, one end of bar 32 is fixed such as by welding to bar 30 at a point slightly inwardly of the horizontal tab 34 of bar 30.

Figure 2:
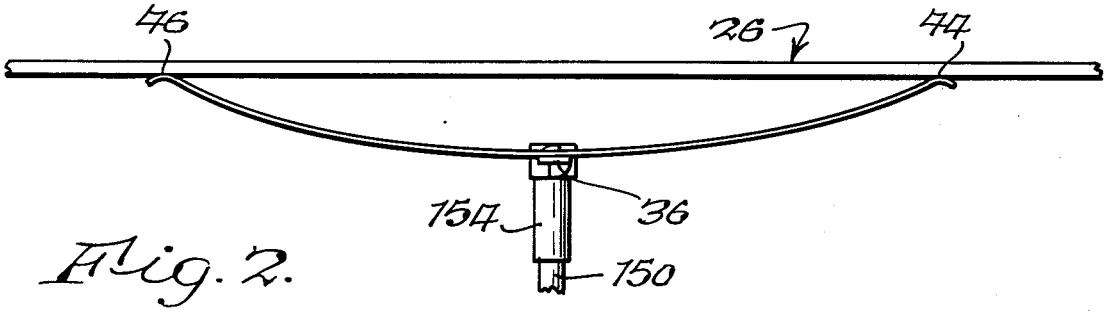
FIG. 2 is a fragmentary elevational view taken about on line 2—2 in FIG. 1.

The panel supporting means 24 further comprises first and second panel engaging elements 32 and 40, respectively, fixed to opposite ends of the bar means, and each of the panel engaging elements has a shape such that it contacts the panel 26 at two spaced-apart locations. In particular, each of the panel engaging elements, for example element 40 illustrated in FIG. 2, is in the form of a strip-like element which is curved along the length thereof, is joined substantially at the mid point thereof to the corresponding end of the bar means, and is disposed so that the surface thereof having concave curvature is in a direction facing the panel element 26. In the device shown the element 40 is secured to the tab 36 by a bolt-like fastener designated 42 in FIG. 3. The element 40 terminates at the opposite ends thereof in curved surface portions 44, 46 adjacent the opposite ends thereof, the shape of element 40 being such that in the position which it is mounted the surfaces 44, 46 are located in a plane substantially perpendicular to the direction in which the raising and lowering means 24 is extended and retracted. Surface portions 44, 46 are of convex curvature facing panel 26 and are very small in length or extent compared to the remainder of the surface of element 40. Furthermore, the element 40 is of resilient material, and spring metal or spring steel is preferred. Similarly, the panel engaging element 38 is curved and disposed such that the concave curvature thereof faces panel 26 and is fastened adjacent the midpoint thereof by a bolt-like fastener element 50 to the horizontal tab 34. Element 38 terminates at the opposite ends thereof in two upwardly convex curved surface portions 52 and 54 as shown in FIG. 3 which are very small in length or extent compared to the remainder of the surface of element 38. The shape of element 38 like that of element 40 together with the mounting thereof is such that the surface portions 52, 54 are disposed in the same plane as portions 44, 46 which plane, in turn, is generally perpendicular to the direction of raising and lowering. In addition, the elements 38, 40 preferably are in parallel relation. The panel engaging element 38 also is of resilient material preferably spring metal or spring steel. As shown in FIG. 1, the panel engaging elements 38, 40 have a shape such that they support a panel 26 outwardly of the bar means, in particular in an upwardly spaced relation to the bar means. In the device shown, the overall length of each of the panel engaging elements 38, 40 is less than the smallest dimension of the standard drywall panels for which the device of the present invention is to be used in hoisting and positioning the panels.

FIG. 5 illustrates in further detail the raising and lowering means of the panel hoisting and positioning device of the present invention. The raising and lowering mechanism comprises a first elongated element in the form of a cylinder or tube 60 which is fixed at one end to base 12 and which has a longitudinal axis extending from the base. In particular, tube 60 is disposed such that the longitudinal axis thereof is generally perpendicular to both the base 12 and the supporting surface such as floor 14 over which the base is movable, and as viewed in FIGS. 1 and 5, tube 60 is disposed generally vertically in use. The tube or cylinder 60 can be fixed at the lower end thereof to base 12 by various arrangements, and in the device shown one end of tube 60 is received snugly within a relatively shorter tube or cylinder 62 having an inner diameter substantially equal to the outer diameter of tube 60 and which is fixed at one end such as by a weld 64 to the upper surface of base 12. Tube 62 is disposed vertically as viewed in FIGS. 1 and 5 during use, is of a relatively short overall axial length compared to tube 60, and at the same time is of sufficient axial length to provide adequate support for the tube 60. Tube 60 is received within tube 62 and extends therealong with the lower end face of tube 60 abutting or contacting the upper surface of base 12 within tube 62. The tubes 60 and 62 are connected together adjacent base 12 by suitable fastening means such as a bolt 66 to prevent relative rotation and axial movement.

The raising and lowering mechanism further comprises a second elongated element in the form of a tube or cylinder 70 which is operatively associated with the first element or tube 60 in a manner allowing relative linear movement between the elements, the second element 70 having a longitudinal axis disposed substantially parallel to the longitudinal axis of the first element 60. In particular, the tube or cylinder 70 has an outer diameter smaller than the inner diameter of cylinder 60 by an amount enabling cylinder 70 to be received within cylinder 60 in telescoping relation. The lowermost end of cylinder 70 as viewed in FIG. 5 abuts against the laterally extending bolt 66, and the upper end thereof as viewed in FIG. 5 extends a relatively small axial distance beyond the upper end of tube 60. Tube 70 has an outer diameter of a size such that it fits relatively snugly within tube 60 while at the same time allowing free relative axial movement. By virtue of the telescoping relation of cylinders 60 and 70, the longitudinal axes of the cylinders are coincident.

The raising and lowering mechanism further comprises motive means generally designated 76 operatively connected to the first and second elements 60 and 70, respectively, for causing relative axial movement between those elements. In particular, the device shown includes a rack 80 on the second element or cylinder 70 and disposed generally parallel to the longitudinal axis thereof. Rack 80 can be a separate component fixed such as by welding or the like to the tube 70 or, the rack and tube can be made integral. Rack 80 extends radially outwardly of tube 70 through a longitudinal slot 84 provided along the outer cylinder 60, and the rack terminates in teeth 86 along the outer surface thereof. The teeth 86 are located radially outwardly of the outer surface of cylinder 60. The rack 80 is of a length such that it extends from a location slightly axially inwardly of the outer upper end of cylinder 70 proceeding in a vertical direction along a major portion of the cylinder 70 to a location slightly axially inwardly of the lower end of cylinder 70 as viewed in FIG. 5. Accordingly, the cylindrical supporting tube 62 likewise is provided with a longitudinal slot 90 in axial alignment with the slot 84 for receiving this portion of the rack 80.

The motive means further comprises a pinion 94 rotatably carried by the first element or cylinder 60 and engaging the rack 80 together with means for rotating the pinion. In particular, pinion 94 is mounted on a shaft 96 which, in turn, is rotatably connected to or carried by a pair of arms 98, 100 fixed to the tube 60 as shown in FIG. 4 in a manner providing a mounting bracket for the shaft and pinion. The location of motive means 76 is adjacent the upper end of tube 60 as viewed in FIG. 1 and 5, and the bracket provided by the arms 98, 100 maintains the teeth of pinion 94 in meshing engagement with the teeth 86 of rack 80. As shown in detail in FIG. 4, pinion 94 is fixed to shaft 96 by a set screw 102. Shaft 96 extends at one end through arm 100 whereupon it terminates in a threaded portion 104 which, in turn, is threaded in a nut 106 which is spaced by a washer 108 from the outer surface of arm 100. The other end of shaft 96 extends through arm 98 whereupon it is fixed to one end of an elongated handle 110 which is provided with a grip 111.

The panel hoisting and positioning device of the present invention further comprises holding means operatively associated with the motive means for maintaining a positional relationship between the first and second elements 60 and 70, respectively, established by the motive means. In particular, the holding means includes a frame having a pair of spaced-apart, generally parallel leg portions 120 and 122 as shown in FIGS. 6 and 7 which are joined such as by welding to the bracket arms 98 and 100, respectively, such as by welding. The opposite ends of the leg portions 120, 122 are joined by an end portion 124 of the frame, and an intermediate section or portion 126 is joined to the leg portions approximately mid-way along the frame. An element in the form of a rod 130 is carried by the frame and is normally biased in a position engaging the pinion 94 in a manner preventing rotation of the pinion and is movable to a position allowing rotation of the pinion. In particular, rod 130 is provided with a wedge-like formation 132 at one end which is normally biased in engagement with pinion 94 between the teeth thereof by means of a biasing spring 136 surrounding element 130 within the frame. Spring 136 has one end thereof abutting or contacting the inner surface of the frame end portion 124 and the opposite end thereof engaging a stop element 138 which is generally washer-like and fixed on rod 130 in a suitable manner. Rod 130 is received in aligned apertures provide in the end portion 124 and intermediate portion 126 of the frame. The rod 130 can be provided a grip 131 at the outer end and also with a guide element alongside which also is rod-like and is disposed generally parallel to rod 130 and received in aligned apertures in the frame end and intermediate portions 124 and 126, respectively.

The raising and lowering mechanism according to the present invention further comprises a third elongated element in the form of a cylinder or tube 150 having a longitudinal axis disposed parallel to the longitudinal axes of the first and second elements 60 and 70, respectively. The third elongated element or tube 150 is connected at one end, i.e. the upper end as viewed in FIG. 1, to the panel supporting means and is operatively associated with the second element or tube 70 in a manner allowing relative linear movement between the two elements. In particular, the cylinder or tube 150 has an outer diameter smaller than the inner diameter of tube 70 by an amount permitting tube 150 to be received within tube 70 in a telescoping manner. Tube 150 fits relatively snugly within tube 70 but in a manner allowing free relative linear or axial movement between the two cylinders. As shown in FIG. 1, the upper end of tube 150 is received within the lower end of a tubular connector element 154, the other end of which is fixed to the two bars 30, 32 of the panel supporting means. The end of tube 150 is fixed in connector 154 by suitable means such as a bolt or pin designated 156. Tube 150 has an axial length such that when fully retracted the bottom end thereof as viewed in FIG. 5 is spaced a short distance axial distance from the corresponding end of tube 70 and the opposite end thereof extends outwardly beyond the upper end of tube 70.

The raising and lowering mechanism further comprises coupling means in the form of a line 160 such as a metal cable which has a fixed length and which is flexible in directions at an angle to the length thereof. The coupling means is fixed at one end to the first element or tube 60, is fixed at the other or opposite end to the third element or tube 150 at a point axially spaced from the end of element 150 which is connected to the panel supporting means, and the coupling means is in operative engagement with the second element or tube 70 between the ends of the coupling means. In particular, line 160 is fixed at one end thereof to the upper end of tube 60 as viewed in FIG. 5 simply by connecting the end of the line 160 to a fastener element 164 which is secured in the outer surface of tube 60 adjacent the upper end thereof. The tube 150 is provided with a slot 168 which extends axially along a major portion of the length of tube 150. Line 160 extends through the slot 168 to the interior of the tube 150 and in the present illustration extends along the length thereof to the bottom end of tube 150 as viewed in FIG. 5 whereupon it is fixed in a suitable manner. For example, the end of line 160 is secured to a connector element 170 which extends generally laterally across the tube 150 at the bottom end thereof and which can be fixed or secured in place in a suitable manner. In the device shown a pulley wheel 174 is rotatably connected to the second element or tube 70 adjacent the upper end thereof as viewed in FIG. 5. In particular, wheel 174 is rotatably connected on a shaft 176 which, in turn, is mounted by a bracket 178 to the upper end of tube 70. Line 160 is trained around about the wheel 174 which, in turn, is accommodated by the slot 168 extending axially along the tube 150.

By way of example, in an illustrative device, base 12 has an overall diameter of about 20½ inches with a weight of about 35 pounds including the casters, and each of the panel engaging elements 38, 40 has an overall length measured end-to-end of about 43 inches, a width of about one inch and a thickness of about one-eighth inch. The perpendicular distance measured from a plane intersecting the mid-points of the convex curved surface portions 44, 46 or 52, 54 to the mid-point of the corresponding element at the innermost point of concave curvature is about 5¾ inches. Each of the metal strips 30, 32 has an overall length of about 3 feet 4 inches, a width of about 1½ inch and a thickness of about one-quarter inch. The overall length of the bar means formed by the strips 30, 32 and measured between the outer edges of the panel engaging or contacting elements 38, 40 in a direction perpendicular to the elements is about 4 feet. Tube 154 which connects the strips 30, 32 to the upper end of tube 150 has an axial length of about 6 inches, an outer diameter of about 1⅞ inch, and an inner diameter of about 1 3/8 inch.

Tube 60 has an overall length of about 4 feet and an outer diameter of about 2½ inches, and slot 84 in the tube has a length of about 44 inches and a width of about ¾ inch. Tube 70 has an overall length of about 4 feet and an outer diameter of about 1⅞ inches, ann rack 80 has a length of about 44 inches. Tube 150 has an overall length of about 4 feet and an outer diameter of 1⅜ inches, and slot 168 in the tube has a length of about 38 inches and a width of about ¼ inch. Tubes 60, 70 and 150 preferably are of metal and have a combined weight of about 37 pounds. Tube 62 has a length of about 10 inches and an inner diameter of about 2½ inches, and slot 90 therein has a length of about 8 inches and a width of about ¾ inch. Rack 80 can have four teeth per inch which determines the number of teeth around pinion 94, and handle 110 has a length of about 18 inches. Line 160 is a ⅛ inch thick steel cable having a length of about 5 feet, and pulley wheel 174 has a diameter of about 1 inch.

In use, the panel hoisting and positioning device is in an initial condition with the three tubes in a fully retracted condition as shown in FIG. 1. A drywall panel 26 is placed by the user onto the panel supporting elements 38, 40 which then hold the panel in a horizontal position as shown in FIG. 1. The device and panel element held thereby is moved over along the supporting surface or floor 14 until it is directly below the location, for example below a ceiling installation, to which the panel 26 is to be raised. The angular disposition of panel 26 in a horizontal plane can be adjusted by rotating base 12 to rotate the entire device and panel 26 therewith or by rotating the panel supporting arrangement 24 about the upper end of the raising and lowering mechanism 20, and both rotations can be performed separately or in conjunction with each other. Also, such adjustments also can be performed while the panel is being raised. In the initial position prior to raising as shown in FIG. 1, the overall height of the apparatus from panel 26 to floor 14 is about 5 feet.

Next, the device is operated to raise panel 26 to the desired height simply by manual turning or cranking of handle 110 to rotate pinion 94 to move tube 70 vertically upwardly within tube 60. In the device shown, handle 110 is turned in a counter clockwise direction about the axis of shaft 96 as viewed in FIGS. 1 and 5 thereby rotating pinion 94 in a counter clockwise direction about the axis of shaft 96, and pinion 94 meshes with teeth 86 of rack 80 to move the rack and the associated tube 70 vertically upwardly. At the same time, pulley wheel 174 fixed to tube 70 also is moved vertically upwardly, and line 160 trained about wheel 174 and fixed at opposite ends to tubes 60 and 150 causes tube 150 to move vertically upwardly relative to tube 70. In the initial, retracted position shown in FIG. 5, the distance along line 160 from pulley 174 to the end of line 160 fixed to the upper end of tube 60 is a minimum, and this distance increases to a maximum as the tubes 70 and 150 are extended. Similarly, the distance along line 160 from pulley 174 to the end of line 160 fixed to the lower end of tube 150 is a mamimum in the initial retracted position shown in FIG. 5 and this decreases to a minimum as the tubes 70 and 150 are extended. The user continues to crank or turn handle 110 until panel 26 is raised to the desired height. During such operation, tube 70 is extended relative to the fixed tube 60, and tube 150 is extended relative to tube 70. When the device is operated to a fully extended condition, the lower end of tube 70 is adjacent and below the upper end of tube 60 and the lower end of tube 150 is adjacent and below the upper end of tube 70. In such a fully extended condition, a panel 26 carried by a device constructed according to the foregoing example is raised to an elevation of about twelve feet above the surface 14.

During operation of the device, either raising or lowering, rotation of pinion 94 in either direction moves element 130 in an outward direction relative to the pinion and rack teeth against the biasing force of spring 136. The locking pin element 130 in effect rides on the pinion teeth and rack teeth during movement of the pinion and rack, and this is facilitated by the wedge-like formation 132. Such movement of element 130 is guided by the element 142 as previously explained. Whenever the user stops turning handle 110 thereby stopping rotation of pinion 94, spring 136 urges the end 132 of pin 130 into locking engagement with the teeth of pinion 94 preventing rotation and maintaining the vertical positional relationship between tubes 60 and 70. The vertical positional relationship between tubes 70 and 150 is maintained by the line 160 of fixed length. Then when it is desired to raise or lower further, handle 110 is turned in the appropriate direction and disengagement of pin 130 from the rack and pinion teeth can be facilitated by pulling the pin outwardly by means of the grip end portion 131.

When the device of the present invention is used in installing drywall panels on ceilings, the device is operated to raise the panel into position contacting the ceiling joists. As previously explained, either or both of the base 12 or panel supporting means 24 can be rotated about the vertical axis of the device to adjust alignment of the panel as it is raised into place. When the panle 26 initially contacts the joists, the curvature of the flexible elements 38, 40 remains. Additional turning of handle 110 in a raising direction tends to reduce the curvature of elements 38, 40 and moving the surface portions 44, 46 and 52, 54 along the surface of panel 26. This flexibility or play in the panel supporting elements 38, 40 is important in insuring a tight fit and placement of the panel against the ceiling joists in a manner accommodating any surface uneveness, especially in the floor or surface 14 supporting the device relative to the ceiling. With handle 110 turned to an extent causing the elements 38, 40 to hold the panel firmly and positively in place, handle 110 is released by the user allowing pin 130 to hold or lock the device whereupon the user then nails or otherwise secures the panel in place. All of the foregoing advantageously is done by only one person using the device of the present invention. When the panel is secured in place, the user turns handle 110 in a clockwise direction to release elements 38, 40 which spring back to their original curvature and to lower and retract the tubes enabling the device to receive another panel to be raised and installed.

It is therefore apparent that the present invention accomplishes its intended objects. While a single embodiment of the present invention has been described in detail, this is for the purpose of illustration, not limitation.

I claim:

1.A panel hoisting and positioning device comprising:

(a) a maneuverable base;

(b) a raising and lowering means having a stationary component fixed to said base and a movable component operatively associated with said stationary component and adapted to be raised and lowered relative to said base; and (c) panel supporting means connected to said raising and lowering means including bar means connected generally centrally thereof to said movable component of said raising and lowering means and disposed generally perpendicular to the direction said component is raised and lowered and first and second panel engaging elements fixed to opposite ends of said bar means, each of said panel engaging elements having a shape such that it contacts a panel at two spaced apart panel contacting sections of said element, each of said sections being in the form of a strip having a convex curvature along the length of the strip in a direction facing the panel, each of said sections contacting the panel along the entire width of the strip, and each of said panel engaging elements being flexible at least in the portions thereof including said panel contacting sections.

2. The device according to claim 1, wherein said panel engaging elements are elongated and disposed in generally parallel relation.

3. The device according to claim 1, wherein said panel engaging elements are of resilient material.

4. The device according to claim 1, wherein each of said panel engaging elements has a shape such that it normally supports a panel outwardly of said bar means.

5. The device according to claim 1, wherein said panel supporting means is pivotally connected to said raising and lowering means.

6. The device according to claim 1, wherein each of said panel engaging elements is elongated and curved along the length thereof.

7. The device according to claim 1, wherein said raising and lowering means comprises:

(a) a first elongated element constituting said stationary component and fixed at one end to said base and having a longitudinal axis extending from said base;

(b) a second elongated element constituting one part of said movable component and operatively associated with said first element in a manner allowing relative linear movement between said elements, said second element having a longitudinal axis disposed substantially parallel to said longitudinal axis of said first element;

(c) motive means operatively connected to said first and second elements for causing relative axial movement between said elements;

(d) a third elongated element constituting another part of said movable component and having a longitudinal axis disposed parallel to the longitudinal axes of said first and second elements, said third element being connected at one end to said panel supporting means and being operatively associated with said second element in a manner allowing relative linear movement between said elements;

(e) coupling means having a fixed length and being flexible in directions at an angle to the length thereof, said coupling means being fixed at one end to said first element and fixed at the other end to said third element at a point axially spaced from said end connected to said panel supporting means, said coupling means being in operative engagement with said second element between said ends of said coupling means;

(f) whereby said motive means causes said second element to be extended and retracted relative to said first element and said coupling means simultaneously causes said third element to be extended and retracted relative to said second element.

8. In a panel hoisting and positioning device including a maneuverable base, panel supporting means and a raising and lowering mechanism operatively connected to said base and to said panel supporting means for moving said panel supporting means toward and away from said base, said mechanism comprising:

(a) a first elongated element fixed at one end to said base and having a longitudinal axis extending from said base;

(b) a second elongated element operatively associated with said first element in a manner allowing relative linear movement between said elements, said second element having a longitudinal axis disposed substantially parallel to said longitudinal axis of said first element;

(c) motive means operatively connected to said first and second elements for causing relative axial movement between said elements, said motive means comprising a rack on said second element and disposed generally parallel to the longitudinal axis thereof, a pinion rotatably carried by said first element and engaging said rack, and means for rotating said pinion;

(d) a third elongated element having a longitudinal axis disposed parallel to the longitudinal axes of said first and second elements, said third element being connected at one end to said panel supporting means and being operatively associated with said second element in a manner allowing relative linear movement betwen said elements; and (e) coupling means having a fixed length and being flexible in directions at an angle to the length thereof, said coupling means being fixed at one end to said first element and fixed at the other end to said third element at a point axially spaced from said end connected to said panel supporting means, said coupling means being in operative engagement with said second element between said ends of said coupling means;

(f) whereby said motive means causes said second element to be extended and retracted relative to said first element and said coupling means simultaneously causes said third element to be extended and retracted relative to said second element.

9. Apparatus according to claim 8, further including holding means operatively associated with said motive means for maintaining a positional relationship between said first and second elements established by said motive means.

10. Apparatus according to claim 8, further including holding means operatively associated with said motive means and including an element normally biased in a position engaging said pinion preventing rotation of said pinion and movable to a position allowing rotation of said pinion.

11. In a panel hoisting and positioning device including a maneuverable base, panel supporting means and a raising and lowering mechanism operatively connected to said base and to said panel supporting means for moving said panel supporting means toward and away from said base, said mechanism comprising:

(a) a first elongated element fixed at one end to said base and having a longitudinal axis extending from said base;

(b) a second elongated element operatively associated with said first element in a manner allowing relative linear movement between said elements, said second element having a longitudinal axis disposed substantially parallel to said longitudinal axis of said first element;

(c) motive means operatively connected to said first and second elements for causing relative axial movement between said elements;

(d) a third elongated element having a longitudinal axis disposed parallel to the longitudinal axes of said first and second elements, said third element being connected at one end to said panel supporting means and being operatively associated with said second element in a manner allowing relative linear movement between said elements; and (e) coupling means having a fixed length and being flexible in directions at an angle to the length thereof, said coupling means being fixed at one end to said first element and fixed at the other end to said third element at a point axially spaced from said end connected to said panel supporting means, said coupling means being in operative engagement with said second element between said ends of said coupling means, said coupling means comprising a line fixed at one end to the end of said first element remote from said base and fixed at the other end to the end of said third element remote from said panel supporting means;

(f) whereby said motive means causes said second element to be extended and retracted relative to said first element and said coupling means simultaneously causes said third element to be extended and retracted relative to said second element.

12. Apparatus according to claim 11, further including a pulley rotatably connected to said second element, said line being trained on said pulley.

13. Apparatus according to claim 12, wherein said pulley is located on said second element at the end thereof remote from said base.

14. Apparatus according to claim 11, wherein said first, second and third elements comprise first, second and third cylinders, respectively, in telescoping relation.

* * * * *